United States Patent [19]

Fusaka

[11] Patent Number: 4,634,823

[45] Date of Patent: Jan. 6, 1987

[54] UNIT-TYPE OPERATING APPARATUS

[75] Inventor: Yoshifumi Fusaka, Nara, Japan

[73] Assignee: Sharp Kabushiki Kaisha, Osaka, Japan

[21] Appl. No.: 762,323

[22] Filed: Aug. 5, 1985

[30] Foreign Application Priority Data

Aug. 6, 1984 [JP] Japan ..... 59-166858

[51] Int. Cl.[4] ..... H01H 3/16

[52] U.S. Cl. ..... 200/61.58 R

[58] Field of Search ..... 200/61.58 R, 307, 317

[56] References Cited

U.S. PATENT DOCUMENTS

| | | | |
|---|---|---|---|
| 3,784,812 | 1/1974 | Swanberg | 200/317 X |
| 4,121,076 | 10/1978 | Taylor et al. | 200/307 X |
| 4,209,820 | 6/1980 | Rundel et al. | 200/307 X |
| 4,224,484 | 9/1980 | Haas et al. | 200/307 X |
| 4,267,417 | 5/1981 | Koepke | 200/307 X |
| 4,308,433 | 12/1981 | Edwards, Jr. | 200/307 X |
| 4,360,722 | 11/1982 | Georgopulos | 200/317 X |

*Primary Examiner*—J. R. Scott

*Attorney, Agent, or Firm*—Birch, Stewart, Kolasch & Birch

[57] ABSTRACT

A unit-type operating apparatus wherein single or plural operating switches are disposed in an operating unit and a plurality of unit receiving parts whereby the above-mentioned operating unit can be freely inserted or removed are installed in an apparatus main unit, and terminals electrically connecting the above-mentioned operating unit with any one of the above-mentioned unit receiving parts, when the former is loaded in the latter, are provided in the above-mentioned operating unit and the above-mentioned unit receiving parts.

4 Claims, 6 Drawing Figures

UNIT-TYPE OPERATING APPARATUS

BACKGROUND OF THE INVENTION

The present invention relates to an operating apparatus incorporated in an apparatus having single or plural operating means, and specifically relates to an operating apparatus whose position can be changed, being particularly suitable for an electrophotographic copying machine.

In an apparatus providing single or plural operating means, the operability thereof depends largely upon the position at which the operating means is placed. In particular, in an apparatus having plural operating means, such as a copying machine, not only the disposition of the operating apparatus in a copying machine main unit wherein each operating apparatus is disposed in a centralized manner but also disposition in the operating apparatus of the operating switches associated with each operation has a great effect on the operability of the apparatus.

For this reason, operating apparatus is conventionally positioned at the right side of the operating part, and apparatus which are not operated directly, such as display apparatus, alarm apparatus and the like, are positioned at the left side thereof. The operator therefore principally operates the apparatus with the right hand.

However, conventional operating apparatus are fixed to the operating part, therefore having the disadvantage of potentially inconvenient operation, particularly for left-handed operators. When we take into consideration matters such as placing the document, feeding the copy paper and disposing of the paper after copying, even a right-handed operator cannot always easily operate operating apparatus positioned at the right side of the operating part when copying for a long time. In such a situation, the operator is required to move to a position from which he can operate the operating apparatus, thus creating the disadvantage of inconvenient copying work, a disadvantage which is sometimes produced in other apparatus as well.

SUMMARY OF THE INVENTION

In the light of the above-mentioned conventional disadvantages, the purpose of the present invention is to provide a unit-type operating apparatus which can facilitate operation whether by a right-handed or left-handed operator by making the operating apparatus in a main unit movable, thereby shortening the operating time required by reducing the amount of operator movement, however complicated the work.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art. To provide the above objects, the preferred embodiment of the present invention comprises: single or plural operating switches disposed in an operating unit; a plurality of unit receiving parts installed in the main unit into which the operating unit can be freely inserted or from which it can be freely removed; terminals electrically connecting the above-mentioned unit with any one of the unit receiving parts, when the operating unit is loaded into one of the unit receiving parts, are provided in the operating unit and the unit receiving parts.

BRIEF DESCRIPTION OF THE DRAWINGS

The present invention will be better understood from the detailed description given hereinbelow and the accompanying drawings which are given by way of illustration only, and thus are not limitative of the present invention in which.

DESCRIPTION OF THE INVENTION

Hereinafter is a description of the preferred embodiment of the present invention illustrated by drawings taking a copying machine as an example. This embodiment, needless to say, is easily applicable to other equipment.

Figure 1A:
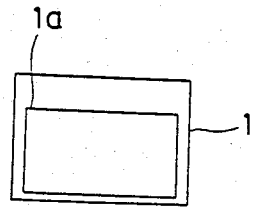
FIG. 1*a* is a view showing a preferred embodiment of an operating unit of the present invention.
Figure 1B:
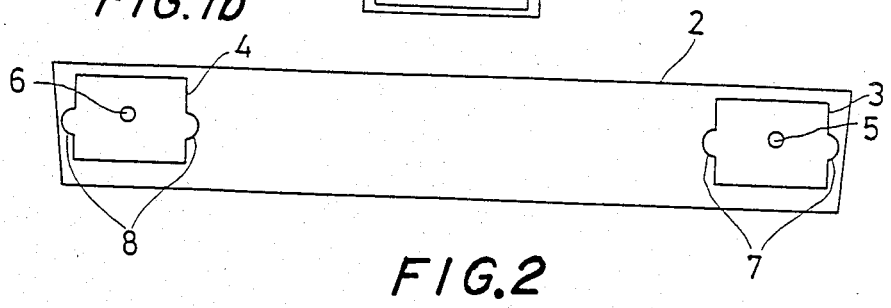
FIG. 1*b* is a view showing a preferred embodiment of an operating part of the present invention.

FIGS. 1*a* and 1*b* show a configuration of a unit-type operating apparatus being a preferred embodiment of the present invention.

An operating unit 1 is shaped as a rectangular thin plate. A copy button 1*a* is disposed on the top surface of this operating unit 1. Also, concave unit receiving parts 3 and 4, nearly identical to the above-mentioned operating unit 1 are installed at both ends of the operating part 2 on the top surface of the copying machine. The top surface of the operating part 2 is flush with the top surface of the operating unit 1 when the operating unit is loaded in either of these unit receiving parts 3 and 4. Also, removable grooves 7 and 8 approximately semicircular in shape are provided in the center of the right and left sides of the unit receiving parts 3 and 4, and the operator can thereby insert his fingers inside from the top surface of the operating part when taking out the operating unit 1. Also, concave-shaped connecting terminals 5 and 6 are disposed on the bottom surface, and electrically connected with terminals disposed on the bottom surface of the operating unit 1 as described later.

Figure 2:
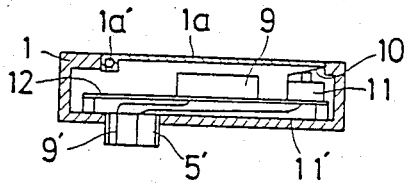
FIG. 2 is a cross-sectional view of an operating unit employed in the said embodiment.

FIG. 2 is a cross-sectional view showing the structure of an operating unit of a unit-type operating apparatus being a preferred embodiment of the present invention. Provided on the top surface of the operating unit main body 1, is the copy button 1*a*, which can rotate freely with a hinge 1*a*′ at one end acting as a fulcrum. This copy button 1*a* is formed in a thin flat plate shape using a light-transparent material, distributing outward the light of a surface light emitting diode LED 9 positioned under the copy button 1*a*. Plate spring 10 and a switch 11 are disposed at the lower part of the other end of the hinge 1*a*′ of the copy button 1*a*, and the switch 11 can be turned on by pressing the copy button 1*a* against the force of the plate spring. This switch 11 and the surface light emitting diode LED 9 are fixed on a printed circuit board 12 installed inside the operating unit main body, and respective wirings 9′ and 11′ thereof are fixed to a convex-shaped connecting terminal 5′ linked with the above-mentioned concave-shaped connecting terminal with the end part exposed from under its bottom surface. The surface light emitting diode LED 9 and the switch 11 are thereby connected to the circuit of the copy machine main unit when the operating unit 1 is loaded in either of the unit receiving parts 3 and 4.

By means of the above-mentioned configuration, the operator loads the operating unit 1 in the unit receiving part 3 at the right end of the operating part to perform copying work when operating with the right hand or when standing to the right of the copy machine, while the operator loads the operating unit 1 in the unit receiving part 4 to perform copying work when operating with the left hand or when standing to the left of the copying machine.

Figure 3:
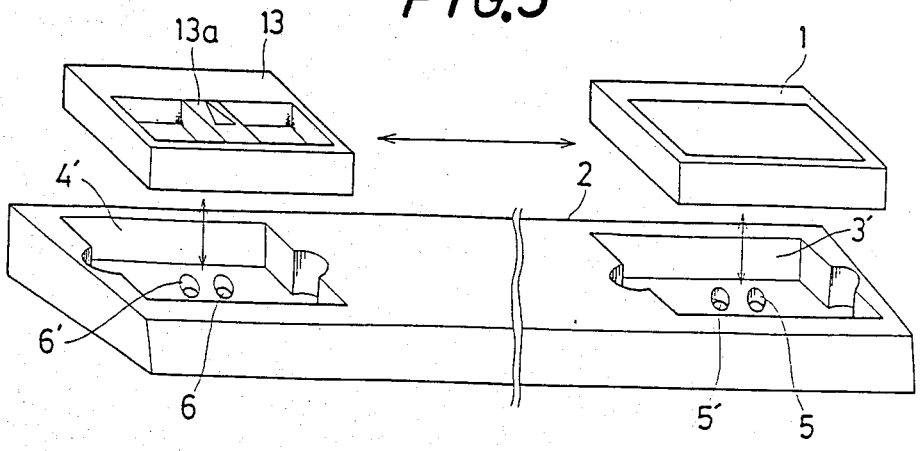
FIG. 3 is a view showing another embodiment in accordance with the present invention.

FIG. 3 is a sketch showing another embodiment of the present invention.

In addition to the copy button operating unit 1, the preferred embodiment shown in the drawing is provided with an exposure adjusting unit similar in size and shape to the copy button operating unit 1 and having exposure adjusting lever 13*a* on its top surface.

The concave-shaped connecting terminals 5, 6, and 5', 6' corresponding respectively to the copy button operating unit 1 and the exposure adjusting unit 13 are positioned on the bottom surface of the unit receiving units 3' and 4' installed at both ends of the operating part 2.

By means of these connecting terminals, the exposure adjusting unit 13 is loaded in the other unit receiving part 4' when the copy button operating unit 1 is loaded in the unit receiving part 3', while exposure adjusting unit 13 is loaded in the unit receiving part 3' when the copy button operating unit 1 is loaded in the unit receiving part 4'. By adopting the configuration as described above, space can be utilized effectively.

Figure 4:
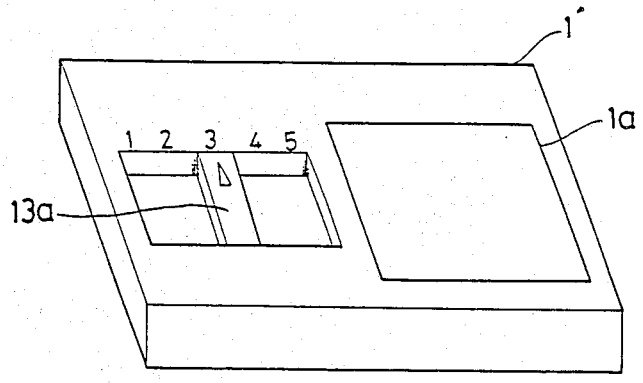
FIG. 4 is a view showing another embodiment of an operating unit constituting the present invention.

FIG. 4 shows another embodiment of the present invention also being an operating unit employed for a unit-type operating apparatus.

The copy button 1*a* and the exposure adjusting lever 13*a* are disposed on the top surface of the operating unit 1'. The above-described configuration remarkably improves operability when adjusting exposure while watching the state of picture formation on the copy paper. In addition, the operating apparatus disposed in the operating unit can be employed in other combinations.

Figure 5:
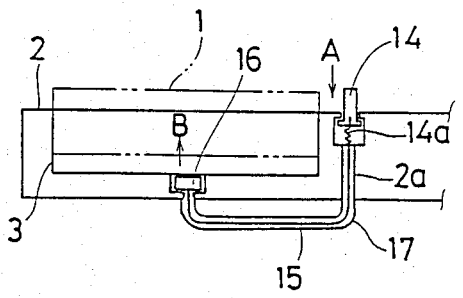
FIG. 5 is a view showing a unit receiving part constituting an embodiment of the present invention.

FIG. 5 shows another embodiment of the present invention being a unit receiving part employed for a unit-type operating apparatus. An eject button 14 and a coil spring 14*a* are positioned in the vicinity of the unit receiving part on the top surface of the operating part 2. A wire 15 with one end fixed to the lower end of the eject button 14 is inserted into a hole located in part 2*a* and a tube 17, and the other end thereof is fixed to the bottom surface of a projection 16 placed on the bottom surface of the unit receiving part.

By depressing the eject button 14 in the direction shown by arrow A against the force of the coil spring 14*a*, projection 16 moves in the direction shown by arrow B, and the operating unit 1 is lifted to the position shown by the dash-colon lines in the drawing. The operator can therefore easily remove the operating unit from the unit receiving part.

Furthermore, in apparatus other than copying machines, a similar effect is obtainable by adopting a similar configuration to that described above wherein switches and others related to operating the loading thereof are disposed in the operating unit, and a plurality of unit receiving parts installed in the apparatus main unit whereby the operating unit can be freely inserted or removed.

In accordance with the present invention, the configuration as described above has the advantages that operation can be performed with an operating apparatus movable in the apparatus main unit, that the operability can be facilitated irrespective of whether the operator is right-handed or left-handed, and that the amount of movement of the operator can be reduced even for complicated work, and therefore the time required for the work can be shortened.

While only certain embodiments of the present invention have been described, it will be apparent to those skilled in the art that various changes and modifications may be made therein without departing from the spirit and scope of the present invention as claimed.

What is claimed is:

1. A unit-type operating apparatus for controlling operation of electrical devices of an apparatus main unit having a plurality of operation stations comprising:

at least one operating unit having a predetermined shape and size;

at least one electrical control switch positioned within said operating unit for controlling at least one operation of at least one electrical device of the apparatus main unit;

at least one operating unit electrical connector operatively connected to said operating unit and in electrical contact with said at least one electrical control switch;

an operating part mounted to the apparatus main unit having at least two receiving parts each having a receptacle of predetermined size and shape as the at least one operating unit;

at least one operating part electrical connector located within each receiving part operatively connected to said operating part and in electrical contact with an electrical device of the apparatus main unit, that is compatible and comes into electrical contact with the at least one operating unit electrical connector when said at least one operating unit is received in the receptacle of one of said at least two receiving parts;

one of said at least two receiving parts is positioned at the left side of the apparatus main unit and one of said at least two receiving parts is positioned at the right side of the apparatus main unit relative to a person operating the apparatus main unit for positioning said at least one operating unit at the left or right side of the apparatus main unit for providing greater operating efficiency by reducing the distance between the at least one electrical control switch and an operation station of the apparatus main unit and for eliminating the need and extra cost for duplicate operating units.

2. The unit-type operating apparatus according to claim 1, in which said at least one operating unit includes:

grooves for providing finger gripping means for an operator.

3. The unit-type operating apparatus according to claim 1, in which said operating part includes:

at least two eject buttons mounted on the operating part with at least one eject button adjacent each of said at least two receiving parts;

at least one wire having two ends with one end connected to said eject button;

at least one tube in which said wire passes through;

at least one projection connected to the other end of said wire and located within each receptacle;

at least one coil spring biasing said eject button, for resetting its position and creating a tension in said wire for retracting said projection located in each said at least two receiving parts;

said at least one projection biases said at least one operating unit, when located within said receptacle, upon an operator pushing the eject button which in turn actuates said wire and in turn said projection for partially dislodging the at least one operating unit to allow an operator to grip and transfer the operating unit to another receiving part.

4. The unit-type operating apparatus according to claim 1 in which said electric connector of said at least one operating unit and said electrical connector of at least one receiving part define as male-female type connectors.

* * * * *